US009047810B2

(12) United States Patent
Li et al.

(10) Patent No.: US 9,047,810 B2
(45) Date of Patent: Jun. 2, 2015

(54) CIRCUITS FOR ELIMINATING GHOSTING PHENOMENA IN DISPLAY PANEL HAVING LIGHT EMITTERS

(75) Inventors: Eric Li, Milpitas, CA (US); Yutao Chen, Guangzhou (CN); Jianxin Xue, Shanghai (CN); Wenjie Yang, Guangzhou (CN); Shoulin Li, Guangzhou (CN); Chun Lu, San Jose, CA (US); Zhifeng Wen, Foshan (CN); Shean-Yih Chiou, San Jose, CA (US); Shang-Kuan Tang, Fremont, CA (US); Shahnad Nadershahi, Simi Valley, CA (US)

(73) Assignee: SCT TECHNOLOGY, LTD., Grand Cayman (KY)

( * ) Notice: Subject to any disclaimer, the term of this patent is extended or adjusted under 35 U.S.C. 154(b) by 340 days.

(21) Appl. No.: 13/397,669

(22) Filed: Feb. 15, 2012

(65) Prior Publication Data

US 2012/0206430 A1 Aug. 16, 2012

Related U.S. Application Data

(60) Provisional application No. 61/443,703, filed on Feb. 16, 2011.

(51) Int. Cl.
*G09G 3/32* (2006.01)
*G09G 3/36* (2006.01)

(52) U.S. Cl.
CPC ..... *G09G 3/32* (2013.01); *G09G 2300/06* (2013.01); *G09G 2310/0248* (2013.01); *G09G 2310/0275* (2013.01); *G09G 2330/025* (2013.01); *G09G 2330/04* (2013.01)

(58) Field of Classification Search
CPC ..... G09G 3/30; G09G 3/32; G09G 3/3216; G09G 3/3266; G09G 3/3291; G09G 2300/06; G09G 2310/0248; G09G 2330/025
USPC ..... 345/82, 211; 315/169.3
See application file for complete search history.

(56) References Cited

U.S. PATENT DOCUMENTS

| | | | | |
|---|---|---|---|---|
| 3,746,780 | A * | 7/1973 | Stetten et al. | 386/239 |
| 5,552,677 | A | 9/1996 | Pagones | |
| 5,723,950 | A * | 3/1998 | Wei et al. | 315/169.3 |
| 6,339,415 | B2 | 1/2002 | Ishizuka | |
| 6,747,617 | B1 | 6/2004 | Kawashima | |
| 7,015,882 | B2 | 3/2006 | Yumoto | |
| 7,019,721 | B2 | 3/2006 | Thielemans et al. | |

(Continued)

*Primary Examiner* — Chanh Nguyen
*Assistant Examiner* — John Kirkpatrick
(74) *Attorney, Agent, or Firm* — Novick, Kim & Lee, PLLC; Allen Xue

(57) ABSTRACT

The present disclosure provides a circuit for discharging parasitic capacitance in a display panel with common-anode topology having a plurality of light emitters, as well as a circuit for charging parasitic capacitance in a display panel with common-cathode topology. In the common-cathode topology, the circuit includes a three-terminal device having a gate, a source, and a drain, wherein one of the source and the drain is electrically coupled to a common cathode of the light emitters, and a mechanism for controlling the three-terminal device, the mechanism being electrically coupled to the gate. Shortly after a previously selected light emitter is unselected, the mechanism turns on the three-terminal device to form a conductive path between the source and the drain. The mechanism turns off the three-terminal device after a voltage at the common cathode is increased to a predetermined voltage level or after a maximum period of time lapses.

6 Claims, 9 Drawing Sheets

(56) References Cited

U.S. PATENT DOCUMENTS

| | | | |
|---|---|---|---|
| 7,126,568 | B2 | 10/2006 | LeChevalier |
| 7,277,073 | B2 | 10/2007 | Hattori |
| 7,385,575 | B2 | 6/2008 | Seto |
| 7,446,744 | B2 | 11/2008 | Klein et al. |
| 8,143,794 | B1 | 3/2012 | Li et al. |
| 8,334,660 | B2 | 12/2012 | Li et al. |
| 8,525,424 | B2 | 9/2013 | Li et al. |
| 2003/0090455 | A1 | 5/2003 | Daly |
| 2003/0156101 | A1 | 8/2003 | LeChevalier |
| 2005/0052141 | A1* | 3/2005 | Thielemans et al. ..... 315/169.3 |
| 2005/0140610 | A1 | 6/2005 | Smith et al. |
| 2006/0118700 | A1* | 6/2006 | Chaussy et al. ..... 250/214.1 |
| 2006/0125744 | A1* | 6/2006 | Klein et al. ..... 345/82 |
| 2007/0152923 | A1 | 7/2007 | Baik et al. |
| 2008/0111773 | A1 | 5/2008 | Tsuge |
| 2011/0163941 | A1 | 7/2011 | Li |
| 2012/0176062 | A1 | 7/2012 | Sato et al. |
| 2012/0327129 | A1 | 12/2012 | Li et al. |

* cited by examiner

CIRCUITS FOR ELIMINATING GHOSTING PHENOMENA IN DISPLAY PANEL HAVING LIGHT EMITTERS

RELATED APPLICATION

This application claims the benefit of priority under 35 U.S.C. §119 to U.S. Provisional Application No. 61/443,703, filed on Feb. 16, 2011, the entire contents of which are incorporated herein by reference.

TECHNICAL FIELD

The present disclosure relates to a circuit for driving light emitters, such as light emitting diodes (LED). More particularly, the present disclosure relates to a circuit for driving an LED display including an array of light emitters, so as to reduce, cancel, or eliminate ghost effects and/or ghost images in the LED display.

RELATED ART

A display panel, such as an LED display, may be driven under time-multiplexed topology. One disadvantage of time-multiplexed driving, however, is the appearance of ghost effects and/or ghost images on the display panel.

In general, a ghost effect refers to the trailing of a moving object appearing on a display panel. For LED displays, the ghosting phenomena may be caused by the stray board capacitance (or parasitic capacitance), which generates a ghost current spike and forces the time-multiplexed LEDs to emit a brief flash of light when the LEDs should have been turned off. The exact amplitude, duration, and timing of the ghost current spike in LED depends on the amount of stray capacitance in the circuit, the forward voltage characteristics of the LEDs, the timing characteristics of the switch, etc. This brief flash of light appears illuminated at improper times, resulting in poor image quality.

With the increasing size and resolution of digital LED display panels, the demand for highly leveraged LED drivers in display designs is also growing. This usually leads to a large number of scan lines and switchable configurations that use the same current driver channel for a multiple of LEDs. As a result, a large number of power switching elements and a large number of junction capacitances are required in such devices. The stray capacitance becomes a nuisance in the design of the overall LED display system, because they retain small charges that create the ghosting phenomena.

For at least the above reasons, there is a need to design an LED driving circuit, which can quickly discharge the stray or parasitic charges, so as to reduce or eliminate the ghosting phenomena appeared on LED display panels.

SUMMARY

In one embodiment, there is provided a circuit for discharging parasitic capacitance in a display panel having a plurality of light emitters. The circuit comprises a three-terminal device having a gate, a source, and a drain, wherein one of the source and the drain is electrically coupled to a common anode of the light emitters, and a mechanism for controlling the three-terminal device, the mechanism being electrically coupled to the gate of the three-terminal device. Shortly after a previously selected light emitter is unselected, the mechanism turns on the three-terminal device to form a conductive path between the source and the drain of the three-terminal device, thereby discharging the parasitic capacitance through the conductive path. The mechanism turns off the three-terminal device after a voltage at the common anode is decreased to a predetermined voltage level or after a maximum period of time lapses.

In another embodiment, there is provided a circuit for eliminating ghost image in a display panel having a plurality of light emitters. The circuit includes a first circuit branch, a second circuit branch, and a third circuit branch. The first circuit branch, the second circuit branch, and the third circuit branch are electrically coupled in parallel between a common cathode of the light emitters and a reference voltage. The first circuit branch forms a first conductive path to charge parasitic capacitance in the display panel shortly after a previously selected light emitter is unselected. The second branch forms a second conductive path to charge the parasitic capacitance immediately after a next light emitter is selected. The third branch forms a third conductive path to charge the parasitic capacitance so long as the previously selected light emitter is unselected.

In another embodiment, there is provided a display panel. The display panel includes an array of light emitters having a common cathode, a power source electrically coupled to an anode of the light emitters, a selection circuit including a plurality of switches for sequentially selecting one or more of the light emitters, and a circuit for eliminating ghosting phenomena. The circuit for eliminating ghosting phenomena comprises a charge circuit for eliminating ghost images and a discharge circuit for eliminating ghost effects on the display panel, the discharge circuit comprising a ghost effect cancellation module electrically coupled to the anode of the light emitters, and the charge circuit comprising a ghost image cancellation module electrically coupled to the common cathode of the light emitters.

BRIEF DESCRIPTION OF THE DRAWINGS

The teachings of the present invention can be readily understood by considering the following detailed description in conjunction with the accompanying drawings.

DETAILED DESCRIPTION

Figure 1:
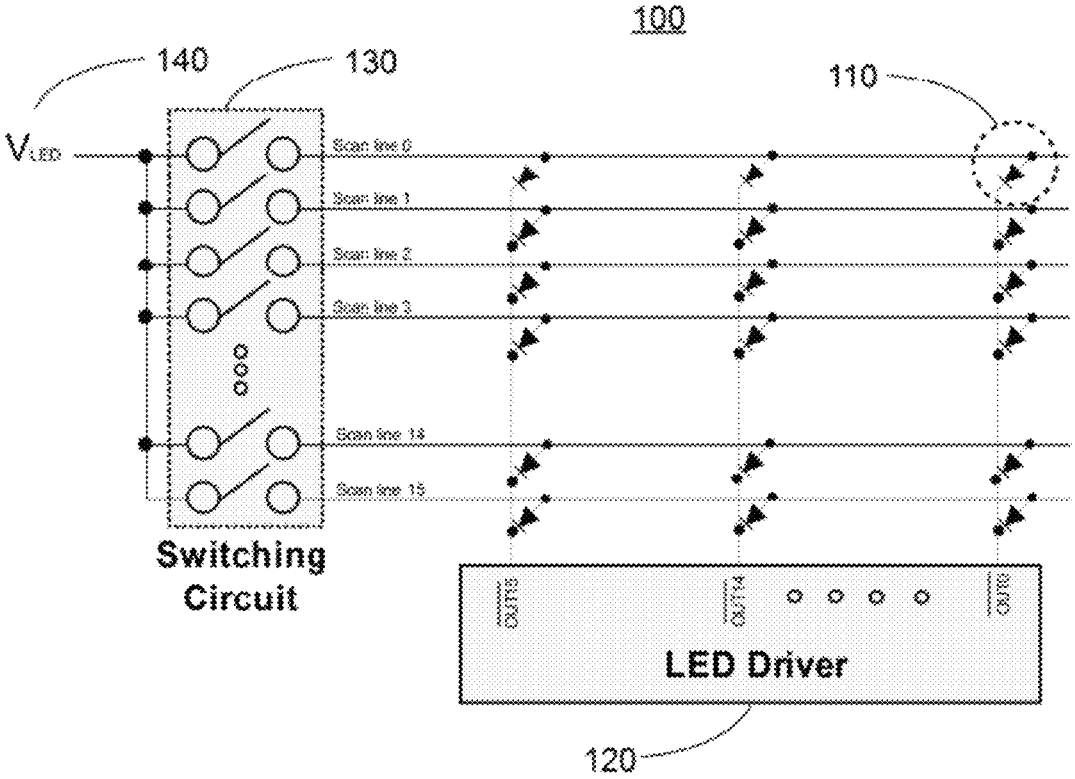
FIG. 1 illustrates a display panel including an array of LEDs in accordance with one embodiment of the present disclosure.

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the present disclosure.

FIG. 1 illustrates an LED display panel 100 in accordance with one embodiment of the present disclosure. In this embodiment, LED display panel 100 is in a common anode configuration. In general, LED display panel 100 includes an LED current driver 120, an array of LEDs 110, and a switching circuit 130 to deliver power to LEDs 110 through a voltage source 140. In this embodiment, current driver 120 is coupled to cathodes of LEDs 110, while switching circuit 130 is coupled to anodes of LEDs 110. As shown in FIG. 1, each pixel of display panel 100 corresponds to one LED (or one LED unit). It is to be understood that each pixel may include two or more LEDs, which may emit light of same or different colors. For example, a color pixel may include three LEDs, each of which can respectively emit light of red, green, and blue colors.

In the embodiment of FIG. 1, display panel 100 includes sixteen scan lines. Each scan line corresponds to one row of sixteen LEDs 110 and is connected to a switch. Accordingly, in this embodiment, switching circuit 130 includes sixteen switches. Further, in this embodiment, display panel 100 includes sixteen columns of LEDs. As shown in FIG. 1, each column includes sixteen LEDs and is connected to the LED current driver 120.

The configuration illustrated in FIG. 1 is easily scalable, by adding additional rows and columns of LED units, additional switches to additional rows, and additional LED current drivers for additional columns. In an alternative embodiment, the size of display matrix can be scaled up to, for example, about 256 by 256.

Figure 2:
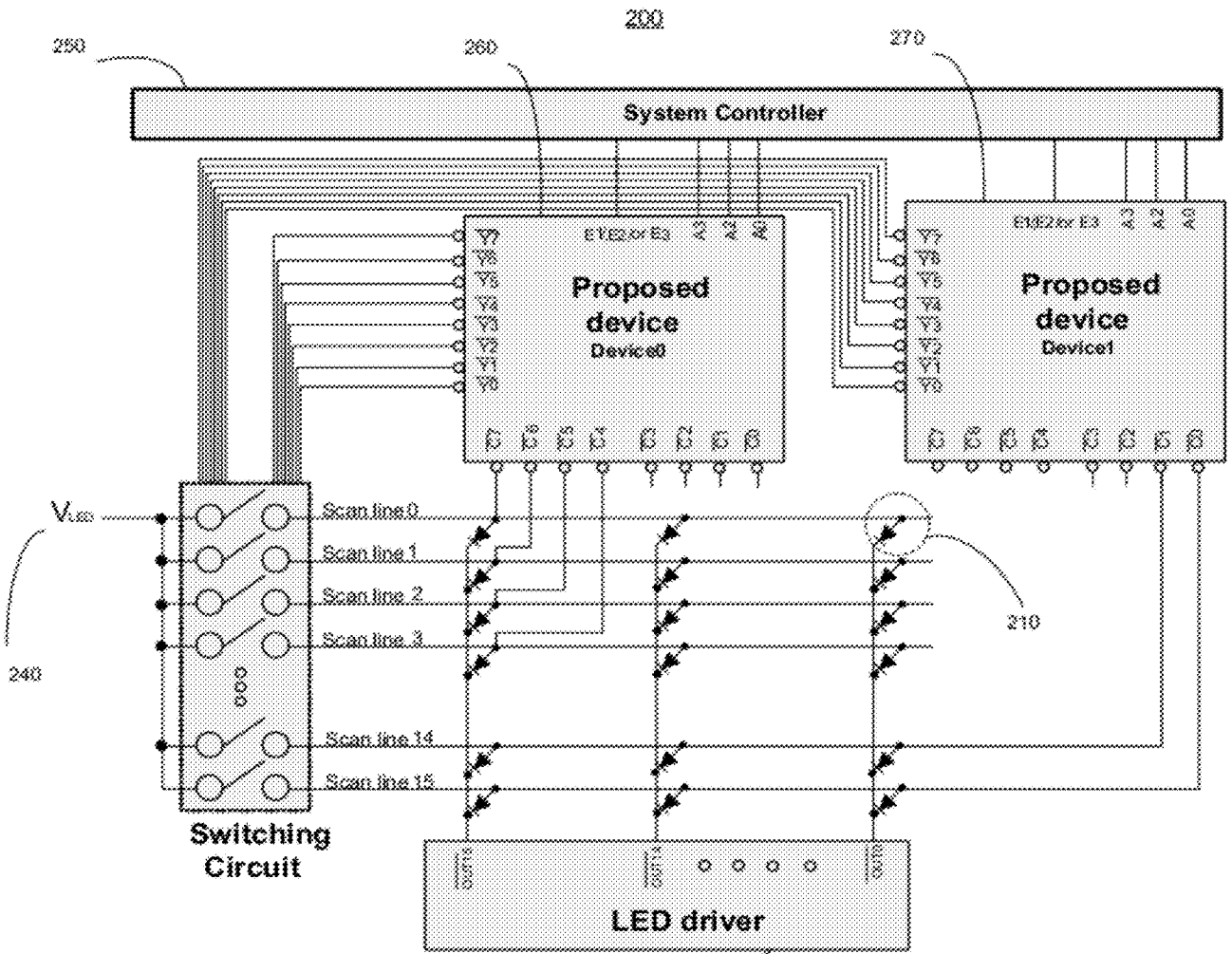
FIG. 2 illustrates an interconnect topology of a display panel in accordance with one embodiment of the present disclosure.

FIG. 2 illustrates an interconnect topology of a display panel 200 in accordance with one embodiment of the present disclosure. Display panel 200 includes an array of LEDs 210, an LED driver 220 coupled with the cathodes of LEDs 210, a switching circuit 240 having a plurality of switches 230 coupled with the anodes of LEDs 210, image correction circuits 260 and 270 coupled with LEDs 210 and switching circuit 230, and a system controller 250 coupled with image correction circuits 260 and 270. Switching circuit 230 selectively delivers power to LEDs 210 through a voltage source 240. System controller 250 controls image correction circuits 260 and 270 to control the timing and to eliminate artifacts, such as ghost images or ghost effects, undesirably shown on display panel 200.

In this particular embodiment, two image correction circuits 260 and 270 are shown and described. Image correction circuit 260 and 270 are coupled to each row of the LED array. Both image correction circuits 260 and 270 are connected to system controller 250, which coordinates the function of these two circuits 260 and 270 to achieve timing control and artifacts elimination.

Figure 3:
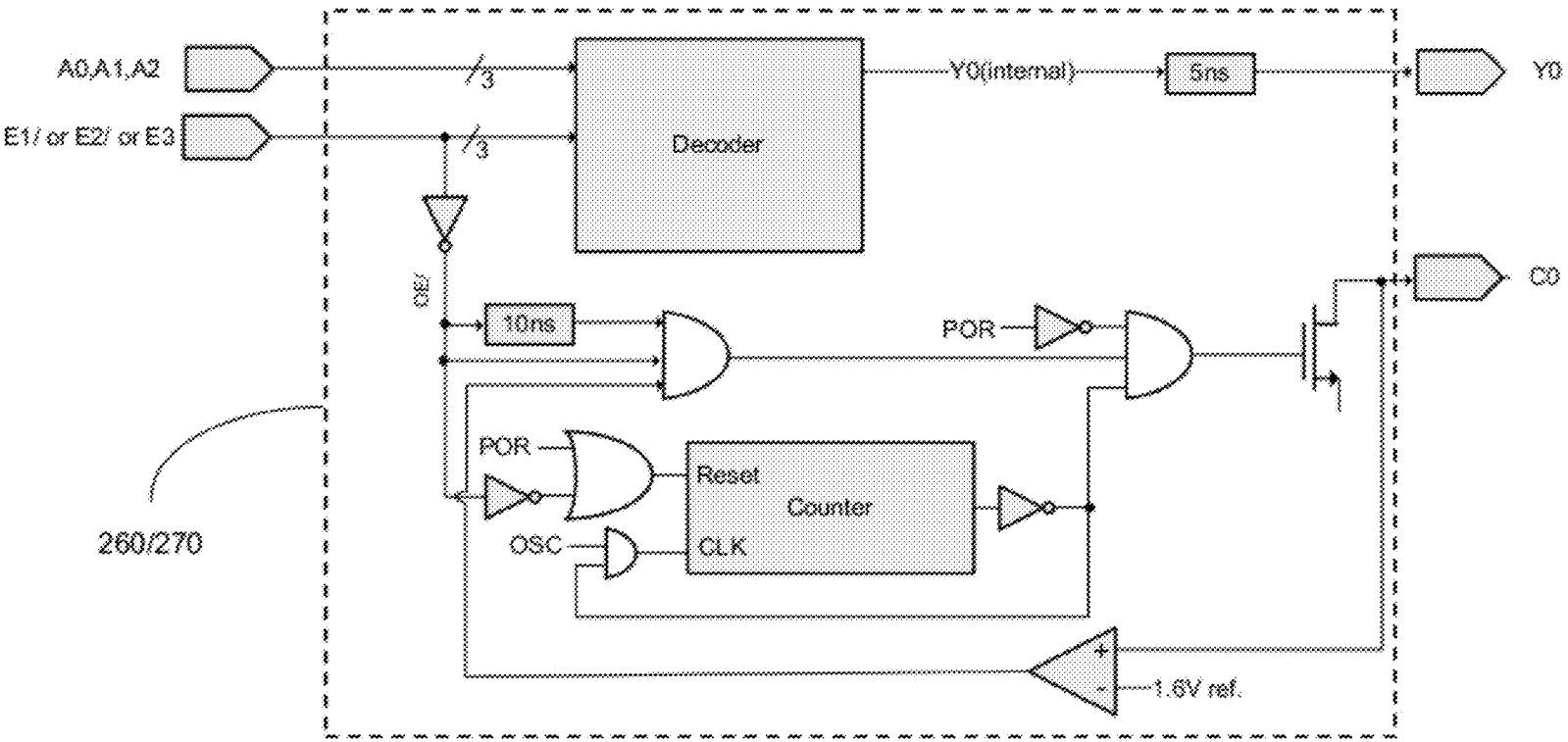
FIG. 3 illustrates an image correction circuit for eliminating ghost effect in a display panel accordance with one embodiment of the present disclosure.

FIG. 3 illustrates an implementation of circuit 260 or 270 for ghost effect elimination. The basic operation of circuit 260/270 as shown in FIG. 3 is as follows. When E1/ or E2/ or E3 internal switches from "LOW" state to "HIGH" state, after 5 nanoseconds delay, the decoder output becomes present (i.e., "active low"). When internal signal OE/ is switched from "LOW" state to "HIGH" state (i.e., "turned off"), the corresponding power switching element PMOS is turned off. After 10 nanoseconds delay, if CXB voltage is higher than 1.6V, the discharge NMOS will be turned on and remain "on" until CX is discharged to voltage level lower than 1.6V. Then, the discharge NMOS will be released by the comparator output. The 1.6V reference voltage is chosen because it is lower than the minimum LED turned-on voltage, as well as to avoid strong reverse bias voltage across LED at the same time. However, the reference voltage can be in the range of 95% to 105% of its nominal value.

Figure 4:
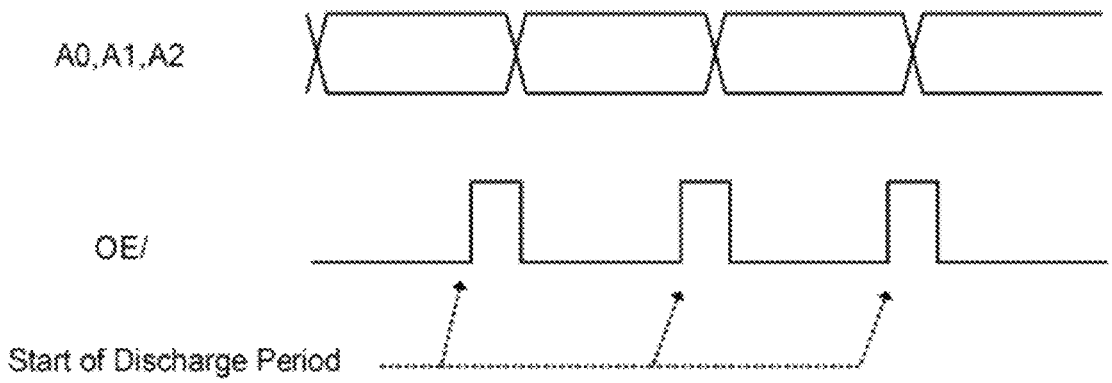
FIG. 4 illustrates how the timer protection works in image correction circuit shown in FIG. 3.

FIG. 4 illustrates how the timer protection works in the image correction circuit shown in FIG. 3. For example, if CX voltage level is always higher than the reference voltage of 1.6V, then the discharge NMOS will be turned on and remains "on." If CX voltage level keeps fluctuating around the reference voltage, then the discharge NMOS will always be chopping. Thus, a timer becomes necessary to prevent such high current risks. When YX internally switches from "LOW" state to "HIGH" state, the timer starts to count. When 500 nanoseconds time period expires, the discharge NMOS will be disabled, without taking care of any CX voltage level, until next YX internal switch.

The power up protection works as follows. In order to prevent any other high current risk during power up stage, POR signal is introduced into circuit 260/270. The timer and discharge NMOS will be released until power supply is at the regulation voltage.

Figure 5:
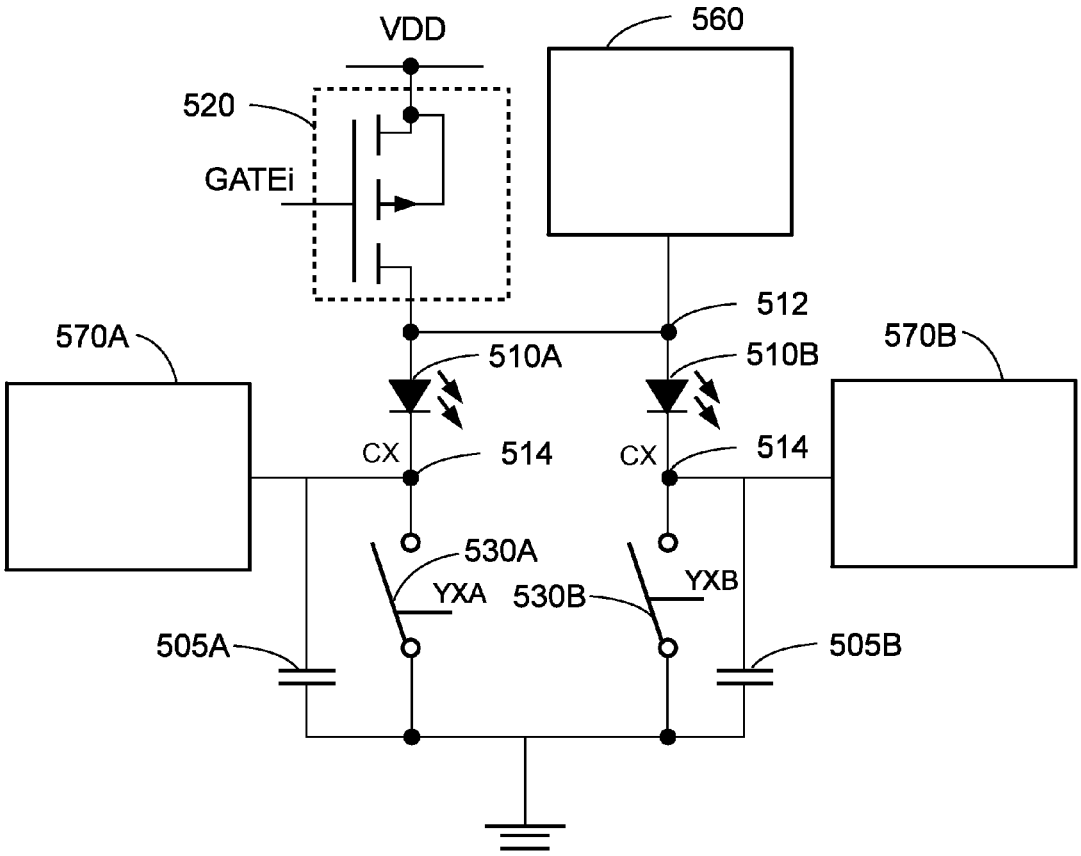
FIG. 5 illustrates a schematic diagram of a circuit for driving a display panel in accordance with another embodiment of the present disclosure.

Referring now to FIG. 5, there is illustrated a circuit for driving a display panel in accordance with another embodiment of the present disclosure. In this embodiment, the display panel is in a common cathode configuration. The circuit may include image correction modules for eliminating ghost effects and/or ghost images in a display panel of a common cathode configuration. For illustrative purposes, only two light emitters 510A and 510B of the display panel are shown in FIG. 5. It is to be understood that the display panel may include any suitable number of light emitters, which may be arrayed or arranged in columns and rows.

In this embodiment, light emitters 510A and 510B are disposed at two neighboring but separate scan lines. In addition, common cathodes 514 of light emitters 510A and 510B are respectively connected to switches 530A and 530B. Further, anodes 512 of light emitters 510A and 510B are connected to a power source 520. Switches 530A and 530B may be turned on and off by sending signals through terminals YXA and YXB, so as to properly select the scan lines of light emitters 510A and 510B.

Figure 6:
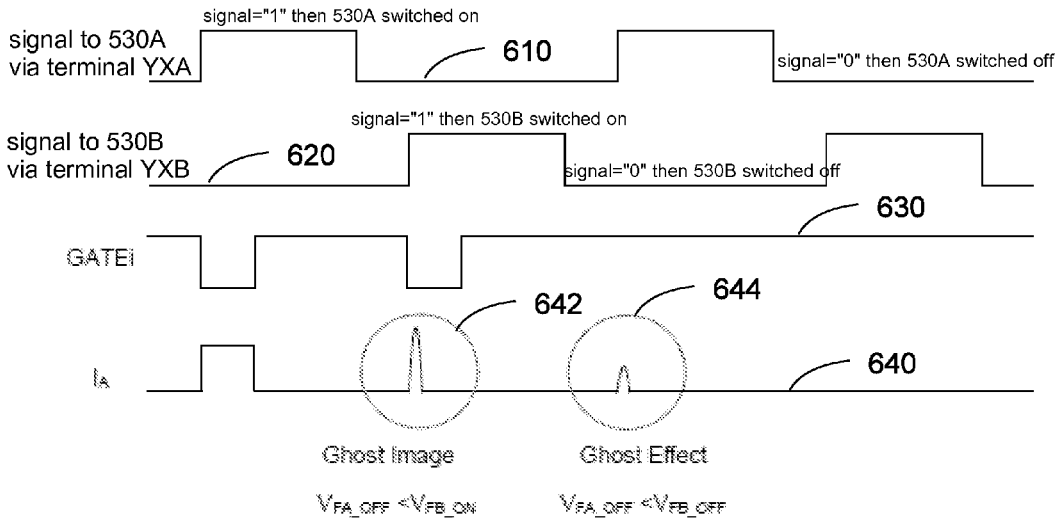
FIG. 6 illustrates timing diagrams for the driving circuit in FIG. 5.

FIG. 6 illustrates exemplary timing diagrams for driving the display panel shown in FIG. 5. In FIG. 6, a higher value of switch 530A or 530B (SWA or SWB) represents a logic "one", while a lower value represents a logic "zero". A higher value of "GATEi" turns OFF power source 520, while a lower value turns ON power source 520. Timing diagram 610 represents the logic states of switch 530A or SWA. Timing diagram 620 represents the logic states of switch 530B or SWB. Timing diagram 630 represents an input signal (such as a pulse width modulation (PWM) signal) to control power source 520. Timing diagram 640 represents current $I_A$ flowing through light emitter 510A.

Referring again to FIG. 5, stray capacitors 505A and 505B may exist in the display panel, which may cause undesirable emission of light from light emitters 510A and 5108 when switches 530A and 530B are turned on and/or off. For example, as shown in FIGS. 5 and 6, when switch 530A is off and when switch 530B is on, light emitter 510A should have been turned off and emit no light. Due to the electric charges stored in stray capacitor 505A, however, a current peak 642 may still be formed in light emitter 510A, thereby causing light emitter 510A to emit a brief flash of light. This brief flash of light generates a fictitious image on the display panel, which is known as the ghost image.

Likewise, when switch 530A is on and when switch 530B is off, a current peak 644 may still be formed in light emitter 510A due to the residual electrical charges remaining in stray capacitor 505A, even if power source 520 is turned off. As a result, light emitter 510 emits a brief flash of light when it is supposed to be off. This is often referred to as the ghost effect.

To eliminate ghost images and ghost effects in the display panel, the circuit in FIG. 5 further includes a ghost effect cancellation module 560 and a ghost image cancellation module 570. In this embodiment, module 560 is electrically coupled to anodes 512 of light emitters 510A and 5108. It is to be understood that, in alternative embodiments, module 560 may be integrated with power source 520. Further, in this embodiment, module 570 may include submodules 570A and 570B, which may be electrically coupled to (common) cathodes 514 of light emitters 510A and 510B, respectively.

Figure 7:
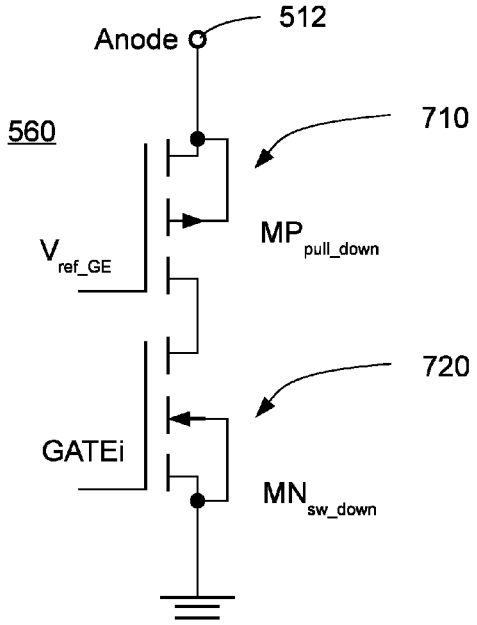
FIG. 7 illustrates an implementation of a ghost effect cancellation module for the driving circuit in FIG. 5.

FIG. 7 illustrates an implementation of ghost effect cancellation module 560 for the circuit in FIG. 5. As shown in FIG. 7, module 560 includes a PMOS transistor 710 and an NMOS transistor 720. In this embodiment, a source of transistor 710 is coupled to anode 512 of light emitters 510A and 5108; a drain of transistor 710 is coupled with a drain of transistor 720; and a source of transistor 720 is grounded. Further, a gate of transistor 710 is coupled with a reference voltage $V_{ref_GE}$, while a gate of transistor 720 is coupled with a control circuit capable of generating a PWM control signal GATE,. When control signal GATE, is high (power source 520 in FIG. 5 is OFF), anode 512 of light emitter 510A may be pulled down through transistors 710 and 720. Transistor 710 may be controlled by a reference voltage $V_{ref_GE}$, which may be about 0.6~1.6V, depending on whether light emitters 510A and 5108 are a red LED or a green/blue LED.

Figure 8:
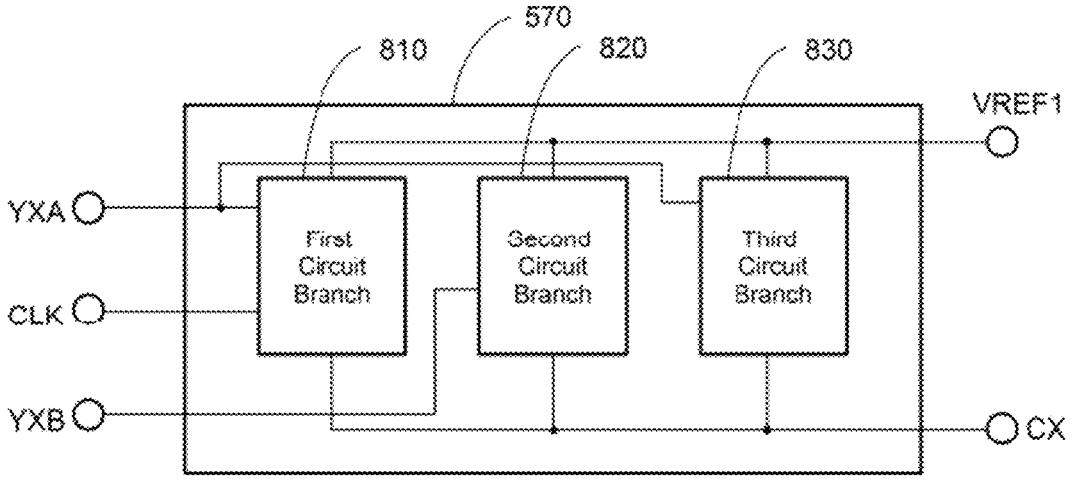
FIG. 8 illustrates an implementation of a ghost image cancellation module for the driving circuit in FIG. 5, the ghost image cancellation module including a first circuit branch, a second circuit branch, and a third circuit branch.

FIG. 8 illustrates an implementation of ghost image cancellation module 570 for the circuit in FIG. 5. As shown, module 570 includes a first (pull up) circuit branch 810, a second (pull up) circuit branch 820, and a third (pull up) circuit branch 830. First circuit branch 810 may be electrically coupled with a reference voltage source VREF1, terminal YXA of switch 530A, a clock signal CLK, and common cathode CX or 514 of light emitters 510A and 5108. Second circuit branch 820 may be electrically coupled to first circuit branch 810, reference voltage source VREF1, and common cathode CX. Third circuit branch 830 may be electrically coupled to reference voltage source VREF1, terminal YXA, and common cathode CX.

In one embodiment, first, second, and third circuit branches 810, 820, and 830 may respectively include a first resistor having a first resistance R1, a second resistor having a second resistance R2, and a third resistor having a third resistance R3. In one embodiment, first resistance R1 is substantially less than second resistance R2, which is substantially less than third resistance R3 (i.e., R1<<R2<<R3). As a result, the three branches 810, 820, and 830 have different pull up strengths, in which first pull up branch 810 is the strongest.

Figure 9:
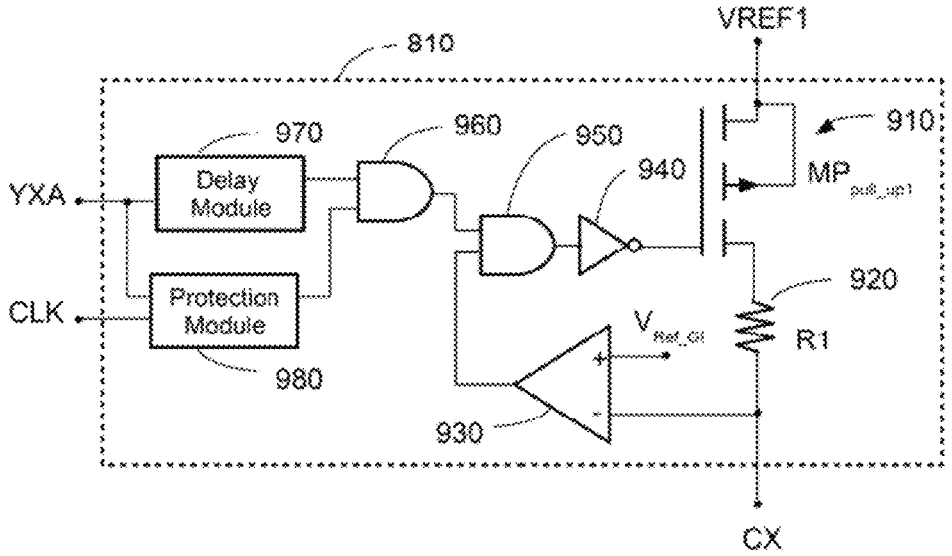
FIG. 9 illustrates a schematic diagram of the first circuit branch of the ghost image cancellation module in FIG. 8.

FIG. 9 illustrates a schematic diagram of first circuit branch 810 in accordance with one embodiment of the present disclosure. In this embodiment, first circuit branch 810 includes a PMOS transistor 910, a resistor 920 having a resistance R1, a comparator 930 for comparing a reference voltage $V_{Ref_GI}$ and a signal from common cathode CX, a NOT gate 940, a first AND gate 950, a second AND gate 960, a delay module 970, and a protection module 980.

Figure 10:
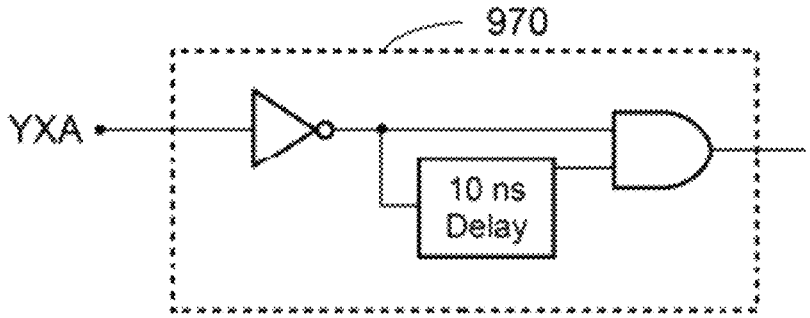
FIG. 10 illustrates a schematic diagram of a delay module of the first circuit branch in FIG. 9.

In this embodiment, first branch 810 is the strongest path, which may pull up common cathode CX after switch 530A is shut off (i.e., terminal YXA turns Low) after a brief delay of, for example, 10 nanoseconds. In this embodiment, the brief delay may be achieved by using delay module 970. FIG. 10 illustrates an example of delay module 970.

Figure 11:
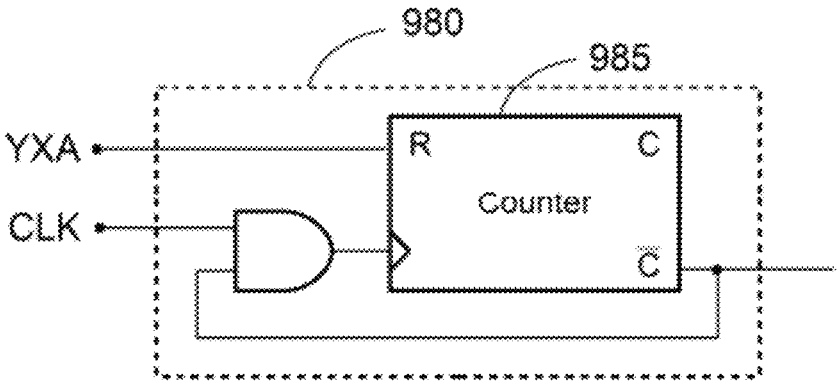
FIG. 11 illustrates a schematic diagram of a protection module of the first circuit branch in FIG. 9.

The current path from common cathode CX to reference voltage VREF1 through resistor 920 and transistor 910 may remain turned ON until a potential at common cathode CX rises up to $V_{ref_GI}$. To protect the circuit, protection module 980 may be used to turn off the current path after a maximum time period (e.g., 300 nanoseconds) has lapsed. FIG. 11 illustrates an example of protection module 980.

Comparator 930 may be used to compare the potential of common cathode CX and reference voltage $V_{ref_GI}$. Once the potential of common cathode CX reaches reference voltage $V_{ref_GI}$, the output of comparator 930 may turn OFF transistor 910. As shown in FIG. 11, protection module 980 may include a digital counter 985, which may be used to count the maximum pull up time. Transistor 910 is shut off, once the maximum time limit is reached. In one embodiment, the maximum time limit is 300 nanoseconds.

Figure 12:
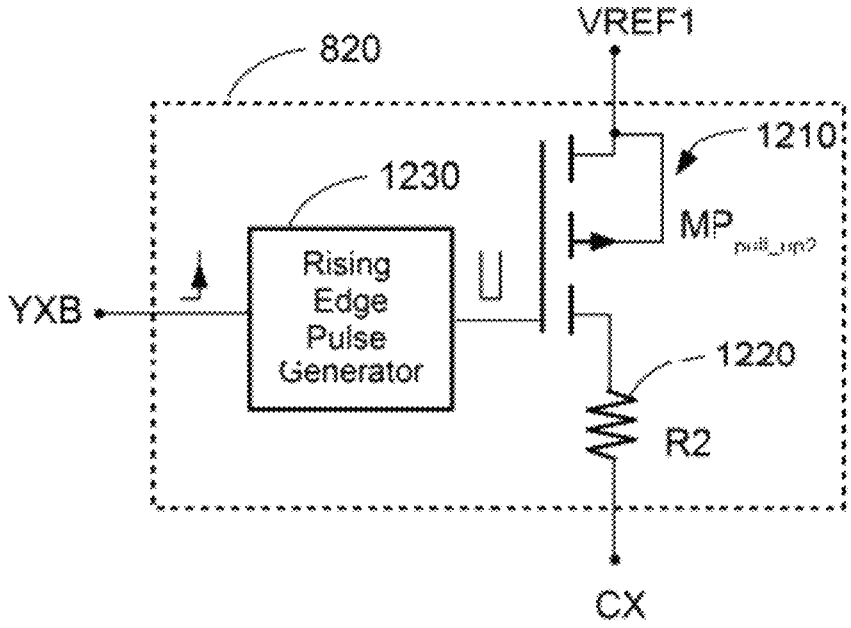
FIG. 12 illustrates a schematic diagram of the second circuit branch of the ghost image cancellation module in FIG. 8.

FIG. 12 illustrates a schematic diagram of second circuit branch 820 of ghost image cancellation module 570 in FIG. 8. Second circuit branch 820 includes a PMOS transistor 1210, a resistor 1220 having a resistance R2, and a rising edge pulse generator 1230. When switch 530B is turned on by a rising signal, rising edge pulse generator 1230 receives the rising signal and converts the rising signal to a pulse signal having a predetermined width. In this embodiment, the width of the pulse signal is about 30 nanoseconds. The pulse signal is then transmitted to a gate of transistor 1210 so as to form a second path from common cathode CX to reference voltage VREF1 through resistor 1220 and transistor 1210. This is effective when switch 530B turns ON (i.e., terminal YXB turns high) and lasts for 30 nanoseconds (the width of the pulse signal). This second path may compensate the potential decrease at common cathode CX, which is caused by capacitor coupling when switch 530B turns ON and when common cathode CX suddenly drops. In this embodiment, resistance R2 of resistor 1220 in second branch 820 is substantially greater than resistance R1 of resistor 920 in first branch 810.

Figure 13:
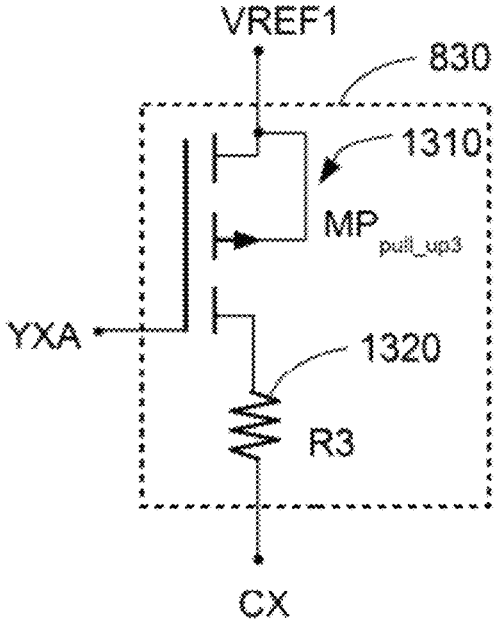
FIG. 13 illustrates a schematic diagram of the third circuit branch of the ghost image cancellation module in FIG. 8.

FIG. 13 illustrates a schematic diagram of third circuit branch 830 of ghost image cancellation module 570 in FIG. 8. Third circuit branch 830 includes a PMOS transistor 1310 and a resistor 1320 having a resistance R3. When switch 530A is turned OFF (i.e., terminal YXA turns Low), a third path is formed from common cathode CX to reference voltage VREF1. The third path can carry a small current (e.g., at an order of magnitude micro Amps) through resistor 1320. The third path is ON as long as switch 530A is turned OFF (i.e., terminal YXA is OFF). This third path may compensate leakage current from terminal YXA to ground. In this embodiment, resistance R3 of resistor 1320 in third branch 830 is substantially greater than resistance R2 of resistor 1220 in second branch 820.

Embodiments of the present disclosure have been described in detail. Other embodiments will become apparent to those skilled in the art from consideration and practice of the present disclosure. Accordingly, it is intended that the specification and the drawings be considered as exemplary and explanatory only, with the true scope of the present disclosure being set forth in the following claims.

What is claimed is:

1. A circuit for eliminating ghost image in a display panel having a plurality of light emitters, the circuit comprising:

a first circuit branch;

a second circuit branch; and a third circuit branch;

wherein the first circuit branch, the second circuit branch, and the third circuit branch are electrically coupled in parallel between a common cathode of the light emitters and a reference voltage;

wherein the first circuit branch forms a first conductive path to charge parasitic capacitance in the display panel shortly after a previously selected light emitter is unselected;

wherein the second branch forms a second conductive path to charge the parasitic capacitance immediately after a next light emitter is selected; and wherein the third branch forms a third conductive path to charge the parasitic capacitance so long as the previously selected light emitter is unselected, wherein the first circuit branch includes a first resistor having a first resistance, the second circuit branch includes a second resistor having a second resistance, and the third circuit branch includes a third resistor having a third resistance, and wherein the first resistance is substantially less than the second resistance, and the second resistance is substantially less than the third resistance.

2. The circuit of claim 1, wherein the first circuit branch comprises:

a first three-terminal device having a gate, a source, and a drain, wherein one of the source and the drain is electrically coupled to the common cathode; and a mechanism for controlling the first three-terminal device, the mechanism being electrically coupled to the gate of the first three-terminal device;

wherein, shortly after the previously selected light emitter is unselected, the mechanism turns on the first three-terminal device to form the first conductive path, thereby charging the parasitic capacitance through the first conductive path; and wherein the mechanism turns off the first three-terminal device after a voltage at the common cathode is increased to a predetermined voltage level or after a maximum period of time lapses.

3. The circuit of claim 1, wherein the second circuit branch includes a second three-terminal device and a rising edge pulse generator.

4. The circuit of claim 3, wherein, after a next light emitter is selected, the rising edge pulse generator generates a pulse signal to turn on the second three-terminal device, thereby forming the second current path.

5. The circuit of claim 4, wherein the pulse signal has a pulse width of about 30 nanoseconds.

6. A display panel, comprising:

an array of light emitters having a plurality of rows of light emitters and a plurality of common cathode nodes, wherein cathodes of light emitters in each row are coupled to a corresponding common cathode node;

a power source electrically coupled to an anode of the light emitters;

a selection circuit including a plurality of switches for sequentially selecting one row of the light emitters at a given time, wherein each switch is electrically coupled to a common cathode node; and a circuit for eliminating ghosting phenomena, the circuit comprising:

a first circuit branch;

a second circuit branch; and a third circuit branch;

wherein the first circuit branch, the second circuit branch, and the third circuit branch are electrically coupled in parallel between a common cathode of the light emitters and a reference voltage;

wherein the first circuit branch forms a first conductive path to charge parasitic capacitance in the display panel shortly after a previously selected light emitter is unselected;

wherein the second branch forms a second conductive path to charge the parasitic capacitance immediately after a next light emitter is selected; and wherein the third branch forms a third conductive path to charge the parasitic capacitance so long as the previously selected light emitter is unselected, wherein the first circuit branch includes a first resistor having a first resistance, the second circuit branch includes a second resistor having a second resistance, and the third circuit branch includes a third resistor having a third resistance, and wherein the first resistance is substantially less than the second resistance, and the second resistance is substantially less than the third resistance.

* * * * *